US005363917A

United States Patent [19]

Jennings et al.

[11] Patent Number: 5,363,917

[45] Date of Patent: Nov. 15, 1994

[54] METHOD OF SAND CONSOLIDATION

[75] Inventors: Alfred R. Jennings, Plano; Eve S. Sprunt, Farmers Branch, both of Tex.; Robert S. Timmer, Bakersfield, Calif.

[73] Assignee: Mobil Oil Corporation, Fairfax, Va.

[21] Appl. No.: 47,986

[22] Filed: Apr. 19, 1993

[51] Int. Cl.[5] ..... E21B 33/13; E21B 43/243

[52] U.S. Cl. ..... 166/288; 166/257

[58] Field of Search ..... 166/257, 288, 309

[56] References Cited

U.S. PATENT DOCUMENTS

| | | | |
|---|---|---|---|
| 3,004,600 | 10/1961 | Henderson et al. | 166/257 |
| 3,044,546 | 7/1962 | Dixon | 166/288 X |
| 3,182,722 | 5/1965 | Reed | 166/288 X |
| 3,414,055 | 12/1968 | Vogt, Jr. . | |
| 3,437,143 | 4/1969 | Cook | 166/285 |
| 3,941,191 | 3/1976 | Pusch | 166/288 |
| 4,378,845 | 4/1983 | Medlin et al. | 166/297 |
| 4,570,710 | 2/1986 | Stowe | 166/250 |

*Primary Examiner*—George A. Suchfield
*Attorney, Agent, or Firm*—Alexander J. McKillop; George W. Hager, Jr.

[57] ABSTRACT

An oxygenated foam is injected into a loosely consolidated, clay-containing sandstone formation surrounding a well penetrating a hydrocarbon-bearing reservoir. Combustion is initiated between the oxygenated foam and hydrocarbons within the reservoir to burn the formation and form said consolidated zone around the well that acts as a barrier to the passage of sand into the well along with produced hydrocarbons.

5 Claims, 1 Drawing Sheet

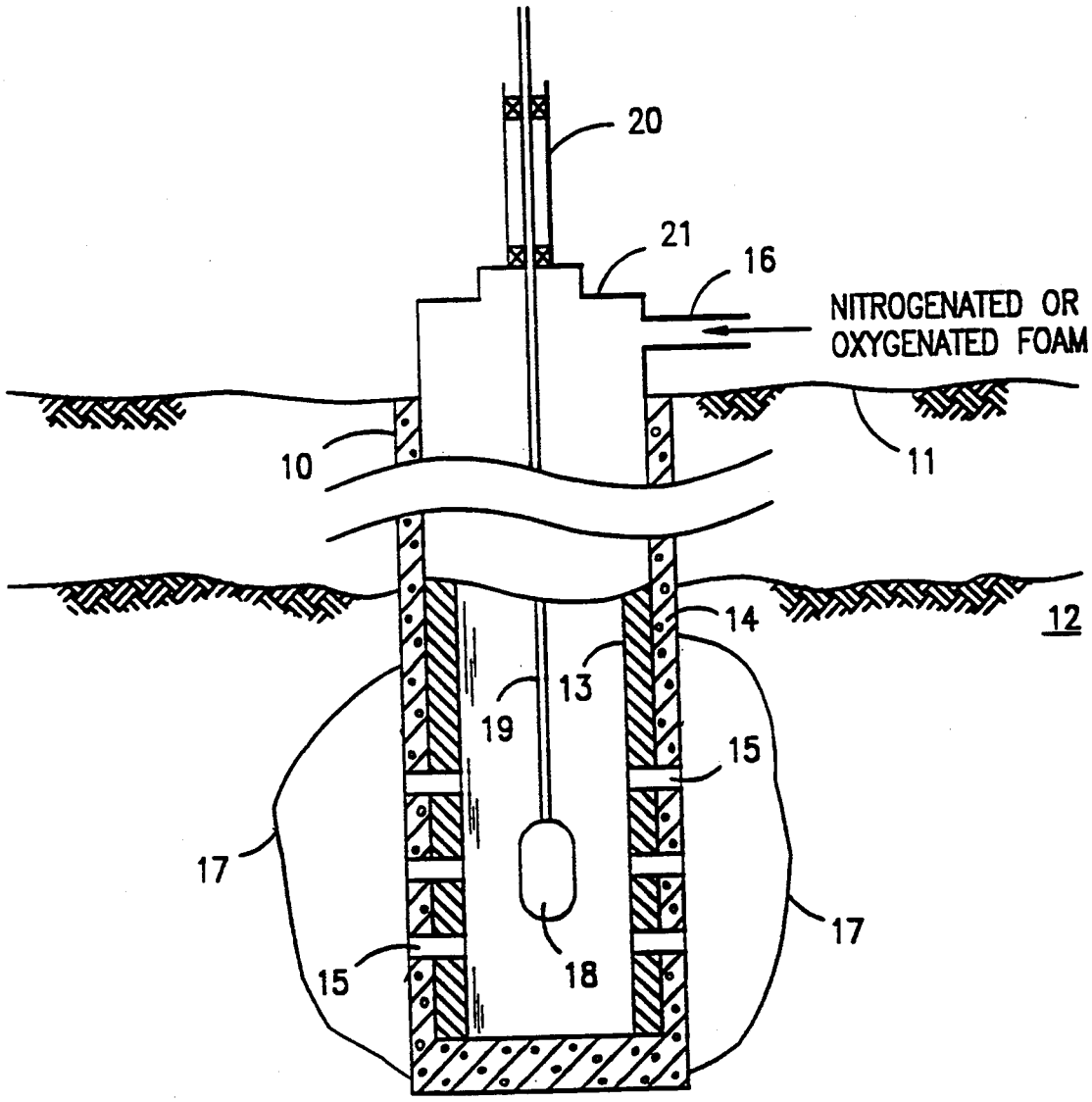
20
21
16
NITROGENATED OR
OXYGENATED FOAM
10
11
12
14
13
19
15
17
17
15
18

METHOD OF SAND CONSOLIDATION

BACKGROUND OF THE INVENTION

This invention relates to sand consolidation of subsurface formations surrounding a wellbore penetrating a hydrocarbon-bearing reservoir and, more particularly, to a method of carrying out in-situ combustion within such formation to effect such consolidation.

In order to limit sand production from hydrocarbon-bearing reservoirs within unconsolidated or loosely consolidated sandstone formations with high clay content, various methods have been employed for preventing sands from entering the production stream. One conventional technique involves the provision of a gravel pack around the wellbore which acts as a filter and prevents production of formation sand. Such a gravel pack generally comprises a region of packed sand and a screen or perforated conduit which is used to aid in communicating fluids through the gravel or sand pack to unpacked regions of the wellbore. Although such gravel packs are often successful at reducing sand production from unconsolidated pay zones, such gravel packs are often difficult to complete and may substantially increase the cost of well production. Also, difficulties often are encountered in removing the gravel pack when it is desired to recomplete or otherwise work over the well.

Another technique involves the injection of resins (i.e., certain epoxies, phenolics and furans) into the formation to effect consolidation. These materials are expensive and work with varying degrees of success. Formation permeability is difficult to control since the resin fills the pore spaces. Resin is difficult to pump and place effectively in the formation. Only limited intervals of about 10 feet or less can be treated effectively. Gravity effects in deviated wellbores cause a problem with placement efficiency because resins are typically pumped as a thin fluid which must be contacted with a catalyst which is pumped in the latter part of the treatment.

Various techniques have been used for heating in-situ such formations. One such technique involves the injection of a heated fluid through the wellbore into the surrounding formation. Another involves the use of downhole heating devices such as electric or gas heaters. One serious shortcoming of such heating techniques is that they often result in uneven heating of the formation. For example, in the injection of a hot fluid into the formation, the fluid will preferentially flow into zones of the formation having relatively high permeability. This results in the occurrence of so-called "hot spots" at the face of the formation where high permeability zones exist with the attendant occurrence of "cold spots" between these zones.

SUMMARY OF THE INVENTION

In accordance with the present invention, there is provided a method for heating a loosely consolidated sandstone formation surrounding a wellbore penetrating a hydrocarbon-bearing reservoir that involves in-situ combustion of such formation to cause consolidation of the sandstone matrix near the wellbore such that the consolidated zone acts as a natural and effective barrier to the passage of formation sand into the wellbore along with the hydrocarbon production stream.

More particularly, a combustion-supporting oxygenated foam, is injected through a well into a loosely consolidated, clay-containing sandstone formation surrounding the well. Combustion is initiated between the oxygenated foam and hydrocarbons within the reservoir to burn the hydrocarbons in the loosely consolidated, clay-containing, sandstone adjacent the well and create a sand consolidation zone that acts as a barrier for the passage of sand into the well along with subsequently produced hydrocarbons.

The burn of the hydrocarbons in the formation adjacent the well may be increased by increasing the oxygen content of the oxygenated foam during combustion. Further, the burn of the hydrocarbons in the formation may be decreased by decreasing the oxygen content of the oxygenated foam during combustion. This may be carried out by pumping nitrogen into the formation during combustion.

In another aspect, the oxygenated foam may comprise a hydrocarbon base fluid which adds to the volatility of the foam.

BRIEF DESCRIPTION OF THE DRAWING

The sole figure of drawings illustrates a subsurface hydrocarbon-bearing reservoir being treated in accordance with the sand consolidation method of the present invention.

DESCRIPTION OF THE PREFERRED EMBODIMENT

For a description of the sand consolidation method of the present invention, reference is made to the drawing where there is shown a well 10 which extends from the surface of the earth 11 and penetrates a subterranean formation 12 which may contain, for example, a hydrocarbon-bearing reservoir. The well 10 includes a casing 13 which is cemented into place by a cement sheath 14. Perforations 15 are provided through the casing 13 and cement sheath 14 to open communication between the interior of the well 10 and the subterranean formation 12.

A combustion-supporting oxygenated foam, is pumped under hydraulic pressure into the well 10 by way of port 16 and out through the perforations 15 into the formation 12 immediately surrounding the well. Combustion is then initiated between the oxygenated foam and hydrocarbons contained within the formation 12 near the well 10. This combustion is particularly effective in the burning of hydrocarbons in the loosely consolidated, clay-containing sandstone adjacent the well to create a sand consolidation zone 17 surrounding the perforations 15 that acts as a natural and effective barrier, or filter, to the passage of sand into the well along with subsequently produced hydrocarbons.

The combustion step is initiated downhole adjacent the formation 12 by the combustion igniter 18 suspended within the well 10 from the surface 11 by means of the conduit 19 set through a high pressure lubricator 20 at the wellhead 21. Any of several well-known types of downhole igniters may be utilized, for example, U.S. Pat No. 2,771,140 to Barclay et al. discloses an electrical igniter, U.S. Pat No. 4,474,237 to W. R. Shu discloses a gas-fired burner and U.S. Pat No. 4,617,997 to A. R. Jennings, Jr. discloses a cannister having an ignitable propellant, the teachings of each of which are incorporated herein by reference.

Suitable foams may range from about 65 to 90 quality (65–90% gas) because foams in this range are fairly stable. It may be desirable to start out with a given quality oxygen foam and then increase or decrease the oxygen content near the end of the burn treatment to effect an increase or decrease in the burn. Air could be used in place of oxygen as the internal phase of the foam. Nitrogen could be used to dilute the oxygen content and to help tailor the treatment by maintaining a given quality foam (i.e., percentage gas) if desired. The foam could further be prepared using hydrocarbons (e.g., diesel) as the base fluid which would add to the volatility of the foam and would greatly increase the safety aspects and concerns for the treatment.

Upon successful completion of the sand consolidation zone 17 within the loosely consolidated sandstone formation 12, the well 10 is placed into production and hydrocarbons from the reservoir within the formation 12 are produced through the well 10 without the presence of formation sands by the filtering effect of the sand consolidation zone 17.

There has now been described and illustrated herein a method for sand consolidation within a loosely consolidated, clay-containing sandstone formation surrounding a hydrocarbon-producing well. However, those skilled in the art will recognize that many modifications and variations besides those specifically set forth may be made in the techniques described herein without departing from the spirit and scope of the invention as set forth in the appended claims.

We claim:

1. A method for sand consolidation of a loosely consolidated, clay-containing sandstone formation surrounding a well penetrating a hydrocarbon-bearing reservoir, comprising the steps of;

a) injecting a combustion-supporting oxygenated foam through said well into said formation surrounding said well, and b) initiating combustion between said oxygenated foam and hydrocarbons within said reservoir to burn hydrocarbons in the formation and create a sand consolidation zone that acts as a barrier to the passage of sand into the well along with produced hydrocarbons.

2. The sand consolidation method of claim 1 further comprising the step of increasing burn of hydrocarbons in the formation adjacent said well by increasing oxygen content of said oxygenated foam during combustion.

3. The sand consolidation method of claim 1 further comprising the step of decreasing burn of hydrocarbons in the formation adjacent said well by decreasing oxygen content of said oxygenated foam during combustion.

4. The sand consolidation method of claim 3 wherein nitrogen is pumped into the formation adjacent said well during combustion.

5. The sand consolidation method of claim 1 wherein said oxygenated foam comprises a hydrocarbon base fluid which adds to the volatility of said foam.

* * * * *